US007567750B2

(12) United States Patent
Yang

(10) Patent No.: US 7,567,750 B2
(45) Date of Patent: Jul. 28, 2009

(54) INSTANTANEOUS WATER HEATER WITH A HEATING TUBE

(76) Inventor: Phile Yang, 5F-3, No. 120, Chung-Zen 1st Rd., Kaohsiung (TW)

( * ) Notice: Subject to any disclaimer, the term of this patent is extended or adjusted under 35 U.S.C. 154(b) by 105 days.

(21) Appl. No.: 11/889,750

(22) Filed: Aug. 16, 2007

(65) Prior Publication Data

US 2009/0047007 A1 Feb. 19, 2009

(51) Int. Cl.
*F24H 1/10* (2006.01)

(52) U.S. Cl. ..... 392/479; 392/496

(58) Field of Classification Search ..... 392/496, 392/479

See application file for complete search history.

(56) References Cited

U.S. PATENT DOCUMENTS 491,320 A * 2/1893 Mitchell ..... 392/496
1,560,528 A * 11/1925 Baum ..... 392/496
2,048,104 A * 7/1936 Clinefelter ..... 392/496
2,987,605 A * 6/1961 Wilhelm ..... 392/496
3,594,544 A * 7/1971 Wunderlich ..... 392/496
4,246,466 A * 1/1981 Rice et al. ..... 392/341
5,838,879 A * 11/1998 Harris ..... 392/451
6,577,817 B2 * 6/2003 Harris ..... 392/481
7,187,855 B2 * 3/2007 Kaastra ..... 392/456

* cited by examiner

*Primary Examiner*—Thor S Campbell
(74) *Attorney, Agent, or Firm*—Rosenberg, Klein & Lee

(57) ABSTRACT

An instantaneous water heater includes a heating tube, a heating device over a lower end of the heating tube, a spiral pipe held in the heating tube, water inlet and outlet pipes connected to two ends of the spiral pipe, a water-discharge switch installed on the other end of the water outlet pipe; the heating tube is made of metal, and emptied of air, and it contains heat media, which will vaporize into gas rapidly when heated by means of the heating device; the heating device isn't powered usually, yet it will be activated to heat the heat media in the heating tube, which in turn transform into gas to heat water in the spiral pipe, as soon as the water-discharge switch is turned on to discharge hot water through the water outlet pipe.

3 Claims, 3 Drawing Sheets

INSTANTANEOUS WATER HEATER WITH A HEATING TUBE

BACKGROUND OF THE INVENTION

1. Field of the Invention

The present invention relates to an instantaneous water heater, more particularly one, which includes a heating tube containing heat media, a heating device over a lower end of the heating tube, a spiral pipe in the heating tube, water inlet and outlet pipes connected to two ends of the spiral pipe, and a water-discharge switch, and which will be activated to heat water immediately after the water-discharge switch is turned on.

2. Brief Description of the Prior Art

Common water heaters, which can be drinking water heaters or bathing water heaters, include a shell, a water tank held in the shell, and a heating device positioned around the water tank. In use, the water tank is substantially filled with water, and the heating device heats water in the water tank up to an intended temperature so that hot water is ready for future use; the heating device will be turned off automatically as soon as the water is heated to the intended temperature. And, the heating device will be reactivated if the water temperature becomes lower than the intended value owing to discharging of hot water and subsequent refilling the tank with cool water/heat escaping away from the hot water over time.

The above water heater has the following drawbacks:

1. The water heater will have to function to turn a full tank of water hot even if the user only needs a small cup of hot water. Therefore, it could waste electricity to use such a water heater.

2. The heating device will be reactivated every time when the temperature of water in the tank becomes lower than the intended value owing to discharging of hot water and subsequent refilling the tank with cool water/heat escaping away from the hot water over time. Therefore, it could waste electricity to use such a water heater.

3. There will be risk of the water tank burning and exploding if the protective device has a fault, and can't function properly to cut off the power to the heating device in lack of water.

SUMMARY OF THE INVENTION

It is a main object of the present invention to provide an instantaneous water heater with a heating tube to overcome the above problems.

An instantaneous water heater according to an embodiment of the present invention includes a heating tube, a heating device over a lower end of the heating tube, a spiral pipe held in the heating tube, water inlet and outlet pipes connected to two ends of the spiral pipe, a water-discharge switch installed on the other end of the water outlet pipe The heating tube is made of metal, and emptied of air, and it contains heat media, which will vaporize into gas rapidly when heated by means of the heating device. To save electricity, the heating device doesn't function usually, yet it will be activated to heat the heat media in the heating tube, which in turn are transformed into gas to heat water in the spiral pipe, immediately after the water-discharge switch is turned on so as to discharge hot water trough the outlet pipe.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
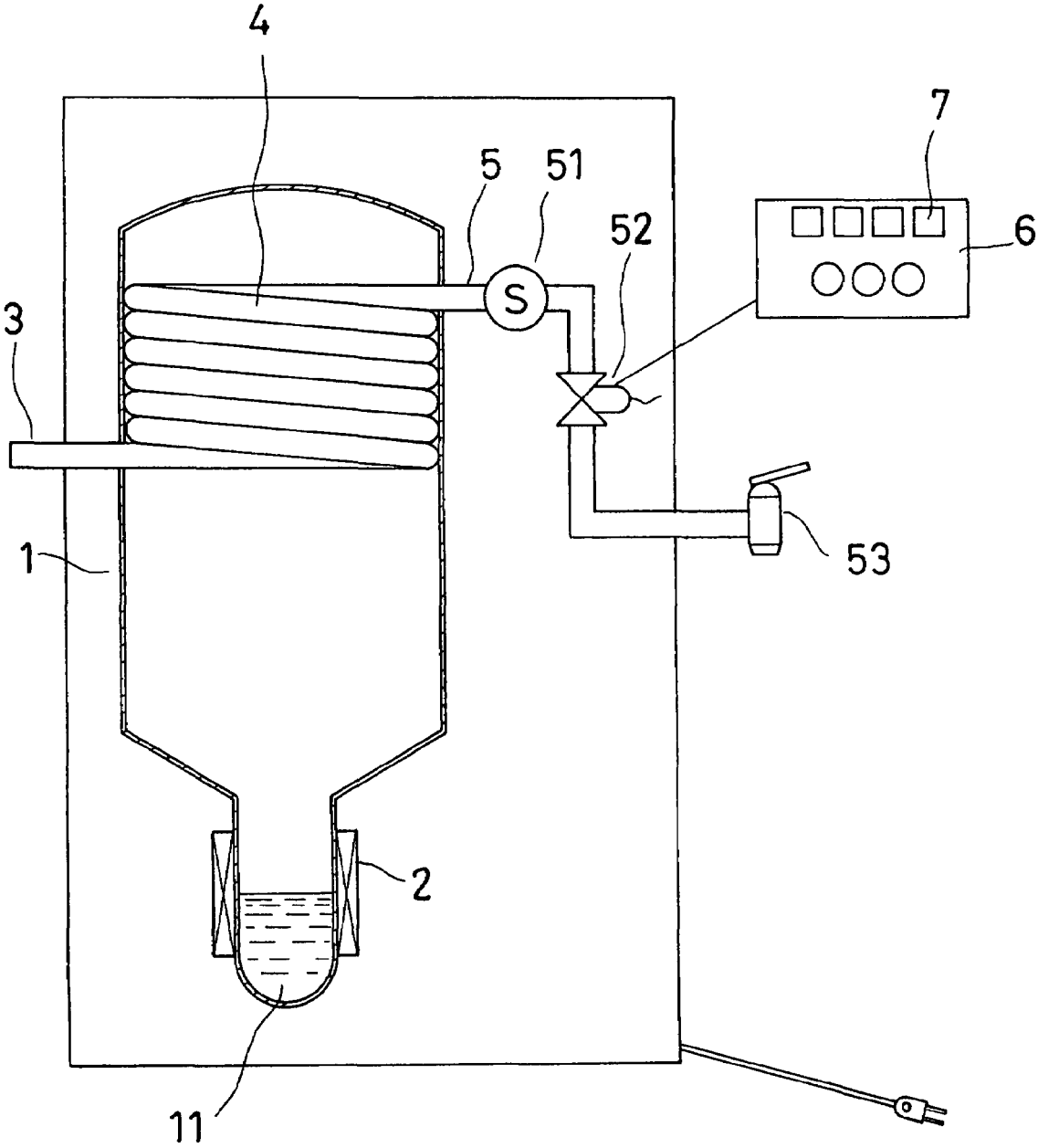
FIG. 1 is a side view of an instantaneous water heater of the present invention.
Figure 2:
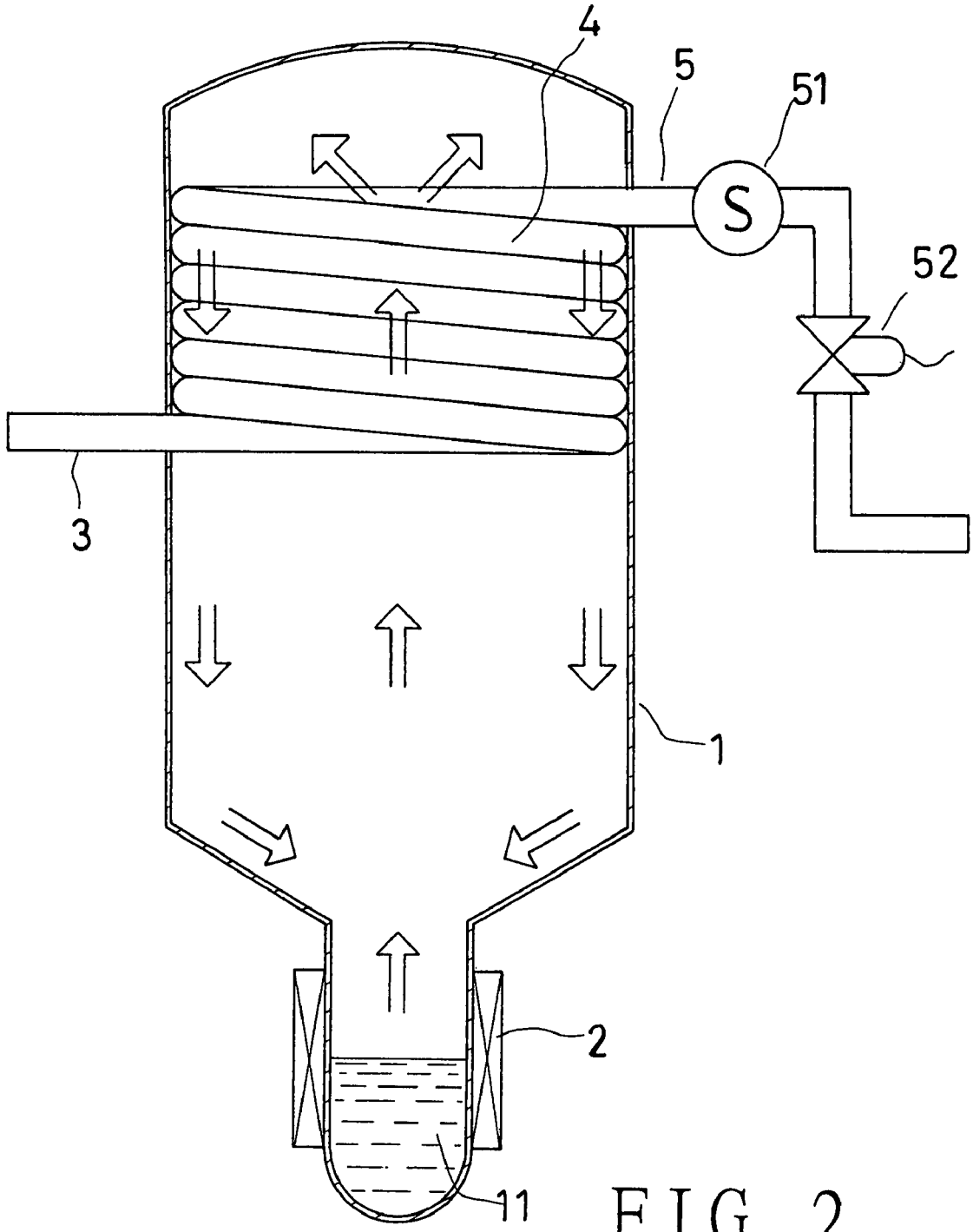
FIG. 2 is a side view of the instantaneous water heater of the present invention, wherein arrows show the direction of motion of the heat media undergoing phase transitions, and medium
Figure 3:
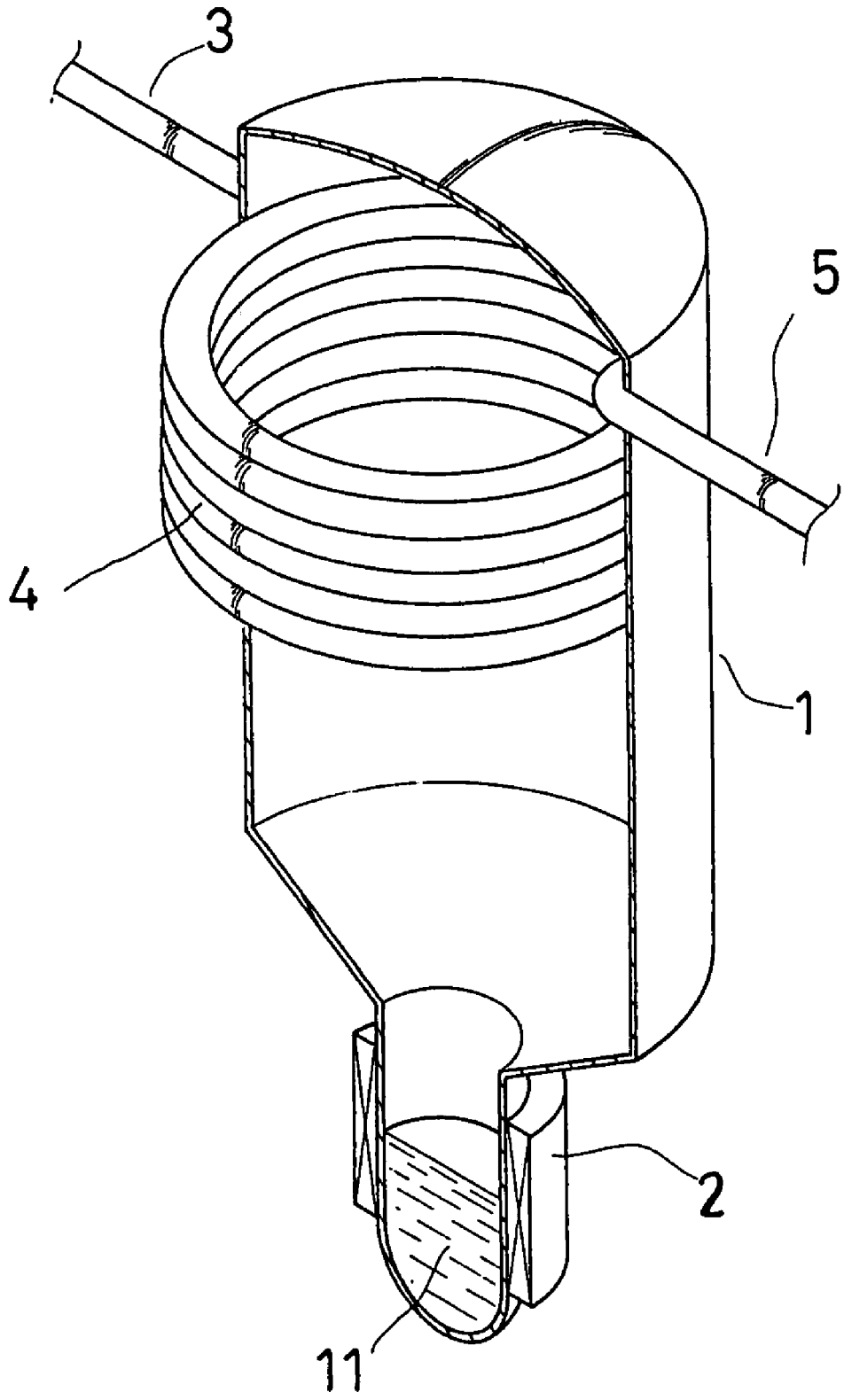
FIG. 3 is a partial perspective sectional view of the instantaneous water heater of the present invention.

Shown in FIGS. 1 and 2 is a preferred embodiment of an instantaneous water heater of the present invention, which can be used to heat drinking water or bathroom water, and which includes a heating tube 1, a heating device 2, a water inlet pipe 3, a spiral pipe 4, a water outlet pipe 5, a water temperature sensor 51, a water-discharge electronic valve 52, a water-discharge switch 53, a control panel 6, and a controlling device 7.

The heating tube 1 is made of metal, and emptied of air, and it contains a small amount of heat media 11.

The heating device 2 is positioned around a lower end of the heating tube 1 to heat the heat tube 1. The heating device 2 can be an electric one. The heating device 2 is provided to heat the heat media 11 contained in the heating tube 1.

The water inlet pipe 3 is passed through one side of the heating tube 1. The spiral pipe 4 is positioned in the heating tube 1, and connected to the water inlet pipe 3 at one end thereof. The water outlet pipe 5 is connected to the other end of the spiral pipe 4, and passed through the other side of the heating tube 1.

The water temperature sensor 51 and the water-discharge electronic valve 52 are fitted on the water outlet pipe 5 in sequence. The water-discharge switch 53 is installed on a tail end of the water outlet pipe 5 in order for a user to operate. The control panel 6 is arranged next to the heating tube 1. The controlling device 7 can be set in respect of temperature, and it is connected to the control panel 6.

The water temperature sensor 51 is provided to detect the temperature of water, and compare the detected water temperature with the value set through the control panel 6; when the water temperature 51 finds out that the water temperature has reached the intended temperature value set through the control panel 6, the controlling device 7 will make the water-discharge electronic valve 52 open in order for allowing water to flow out through the water-discharge switch 53.

When the heat media 11 is heated by means of the heating device 2, it will transform into vapor rapidly, whose temperature is higher than that of water steam. Next, the vapor will pervade an inside of the heating tube 1 so as to heat the spiral pipe 4 and water contained in the spiral pipe 4; thus, the temperature of water in the spiral pipe 4 increases.

In use, referring to FIGS. 1 and 2, first the user sets an intended temperature value through the control panel 6. Next, the water-discharge switch 53 is pressed, causing the heating device 2 to be activated at the same time; thus, the heat media 11 in the heating tube 1 are heated and transformed into vapor rapidly owing to extremely low thermal resistance, and the vapor pervades the inside of the heating tube 1 to heat the spiral pipe 4 for allowing heat exchange to occur between the vapor and water held in the spiral pipe 4. Consequently, the temperature of the water in the spiral pipe 4 rises, and the vapor condenses into liquid, which will flow back to the lower end of the heating tube 1 immediately owing to gravity, and will be heated to undergo a next phase-transition heat cycle. At the same time, the water temperature sensor 51 installed on the water outlet pipe 5 will continue detecting the water temperature; thus, the controlling device 7 will make the water-discharge electronic valve 52 open for allowing hot water to flow out through the water-discharge switch 53 when the water temperature reaches the intended temperature value set through the control panel 6.

From the above description, it can be seen that the present invention has the following advantages:

1. The heating device isn't powered usually, yet it will be activated to heat the heat media in the heating tube, which in turn are transformed into gas to heat water in the spiral pipe, immediately after the water-discharge switch is turned on to discharge hot water. Therefore, it won't waste power to use the instantaneous water heater of the present invention as it would to use the above water heater with a tank, which has to heat water contained therein for future use.

2. Because the heating tube of the heater of the present invention contains a fixed amount of heat media, the pressure of the heat media won't continue to increase after the heat media has completely vaporized. Therefore, there is no risk of the heating tube exploding even if the heating device continues to work without being turned off while there is lack of water.

What is claimed is:

1. An instantaneous water heater with a heating tube, comprising a heating tube made of metal, the heating tube having heat media contained there and being devoid of air;

a heating device over a lower end of the heating tube, the heat media being rapidly vaporized into gas when heated by the heating device;

a water inlet pipe passed through one side of the heating tube;

a spiral pipe, which is held in the heating tube, and connected to the water inlet pipe at one end thereof;

a water outlet pipe, which is arranged on other side of the heating tube, and connected to other end of the spiral pipe at one end thereof; and a water-discharge switch installed on other end of the water outlet pipe.

2. The instantaneous water heater with a heating tube as claimed in claim 1, wherein the heating device is an electric one.

3. The instantaneous water heater with a heating tube as claimed in claim 1 further comprising:

a control panel arranged next to the heating tube;

a controlling device, which is connected to the control panel, and can be reset in respect of temperature;

a water temperature sensor installed on the water outlet pipe to detect water temperature; and a water-discharge electronic valve joined to the water outlet pipe;

the controlling device being going to make the water-discharge electronic valve open for allowing water to flow out through the water-discharge switch when water temperature detected with the water temperature sensor reaches an intended temperature value set through the control panel.

* * * * *